US009916799B1

(12) United States Patent
Jo et al.

(10) Patent No.: US 9,916,799 B1
(45) Date of Patent: Mar. 13, 2018

(54) ADAPTIVE VCOM LEVEL GENERATOR

(71) Applicant: IML International, Grand Cayman (KY)

(72) Inventors: Yoo Dong Jo, Asan-si (KR); Gi Young Lee, Saratoga, CA (US)

(73) Assignee: IML International, Grand Cayman (KY)

( * ) Notice: Subject to any disclaimer, the term of this patent is extended or adjusted under 35 U.S.C. 154(b) by 0 days.

(21) Appl. No.: 15/295,814

(22) Filed: Oct. 17, 2016

Related U.S. Application Data

(60) Provisional application No. 62/244,057, filed on Oct. 20, 2015.

(51) Int. Cl.
*G09G 3/36* (2006.01)
*G09G 5/39* (2006.01)

(52) U.S. Cl.
CPC ..... *G09G 3/3618* (2013.01); *G09G 3/3648* (2013.01); *G09G 3/3685* (2013.01); *G09G 3/3696* (2013.01); *G09G 5/39* (2013.01); *G09G 2310/027* (2013.01); *G09G 2310/0264* (2013.01); *G09G 2310/0289* (2013.01); *G09G 2310/0291* (2013.01); *G09G 2310/08* (2013.01); *G09G 2320/0247* (2013.01); *G09G 2340/0435* (2013.01); *G09G 2360/12* (2013.01)

(58) Field of Classification Search
None
See application file for complete search history.

(56) References Cited

U.S. PATENT DOCUMENTS 5,406,592 A * 4/1995 Baumert ..... H03L 7/087 327/114
5,412,290 A * 5/1995 Helfrich ..... H04N 3/2335 315/371
7,382,201 B1 * 6/2008 Yu ..... H03C 3/0925 331/14
7,680,966 B1 * 3/2010 Falik ..... G11C 5/02 710/10
9,530,380 B2 * 12/2016 Jang ..... G09G 5/00
2002/0126112 A1 * 9/2002 Kato ..... G09G 3/3685 345/204
2004/0017341 A1 * 1/2004 Maki ..... G09G 3/3688 345/87
2006/0181494 A1 * 8/2006 Morita ..... G09G 3/3688 345/89
2007/0091039 A1 * 4/2007 Tada ..... G09G 3/3696 345/87
2009/0058763 A1 * 3/2009 Doi ..... G09G 3/3688 345/55
2011/0101932 A1 * 5/2011 Nakazono ..... H02M 3/1588 323/271
2012/0274624 A1 * 11/2012 Lee ..... G09G 3/3655 345/213
2015/0042631 A1 * 2/2015 Kim ..... G09G 3/3655 345/212
2015/0170609 A1 * 6/2015 Jung ..... G09G 3/20 345/212

* cited by examiner

*Primary Examiner* — Joni Richer
(74) *Attorney, Agent, or Firm* — Aka Chan LLP

(57) ABSTRACT

An adaptive Vcom level generator circuit generates a variable Vcom voltage level. A variable Vcom voltage can be used for variable refresh rate display technology to prevent flicker on a display panel. The Vcom level can be changed based on the vertical frequency being used or can be changed based on external control signals.

22 Claims, 12 Drawing Sheets

ADAPTIVE VCOM LEVEL GENERATOR

DESCRIPTION

CROSS-REFERENCE TO RELATED APPLICATIONS

This application claims the benefit of U.S. patent application 62/244,057, filed Oct. 20, 2015, which is incorporated by reference along with all other references cited in this application.

BACKGROUND OF THE INVENTION

The invention is related to the field of electrical circuits and more specifically to driver circuitry for display panel products.

Electronic visual displays are used in a wide range of applications including computer monitors, televisions, instrument panels, aircraft cockpit displays, and signage. They are common in consumer devices such as laptop computers, video players, music players, gaming devices, clocks, watches, calculators, telephones, smartphones, tablets, and many other devices.

Some examples of display panel technologies include liquid crystal displays (LCDs), organic led emitting diode (OLED) displays, and plasma displays. Such displays operate according to various principles. For example, LCDs use the light modulating properties of liquid crystals to produce images. Since LCDs do not emit light, there is often a backlight behind the LCD panel to illuminate the display. Other display technologies work according to different principles.

Electronics are used to drive an electronic display. These electronics provide power and electrical input. For example, there are voltages for the row and column drivers to drive a thin-film transistor (TFT) LCD. Electronics generate voltage waveforms to achieve (1) color output stability to alleviate flickering and inconsistent color, and (2) liquid crystal stability to prevent display damage due to localized net voltage build-up.

Further, a LCD display panel has a VCOM input. VCOM is adjusted to match the capacitance and performance specifications of the TFT panel to maximize contrast and minimize flickering. The VCOM can be a programmable function, which can be used to adjust a panel to maximize contrast, minimize flickering during operation, and optimize panel performance.

It is desirable to improve electronics used to drive electronic visual displays, so that these displays and the electronics used to drive them to improve performance, reduce cost, and reduce power consumption. Therefore, improved electronics and circuits are needed.

BRIEF SUMMARY OF THE INVENTION

An adaptive Vcom level generator circuit generates a variable Vcom voltage level. A variable Vcom voltage can be used for variable refresh rate display technology to prevent flicker on a display panel. The Vcom level can be changed based on the vertical frequency being used or can be changed based on external control signals.

In an implementation, a method includes adjusting a Vcom level of a display by changing a frame rate for an adaptive sync display. Specifically, the method of changing the Vcom level can include:

1. By receiving an instructive signal to adjust to a certain or specific Vcom level from a timing controller chip or integrated circuit, such as frame rate information.

2. Measuring the vertical frame start signal from a timing controller circuit (e.g., determining a frame rate by circuitry on such a chip), and adjusting the Vcom level to corresponding optimum level.

In an implementation, a device includes: a frequency detector circuit, connected to a vertical frequency signal line of a display; a frequency value circuit, connected to the frequency detector circuit, where the frequency value circuit includes a digital frequency data table having rows and columns, where each row has a column to store a digital frequency value corresponding to a frequency assigned to that row; a register block, connected to receive a digital frequency value from the frequency value circuit; a digital-to-analog converter circuit, connected to the register block; a first operational amplifier, having a first input connected to the register block; a transistor connected to an output and a second input of the first operational amplifier; and a second operational amplifier, including a first input connected to the transistor and a output connected to a VCOM voltage output.

In various implementations, the device can include an oscillator, connected to the frequency detector circuit. The device can include a digital interface control circuit, connected to the register block and the frequency value circuit. The device can include: a first impedance connected between a supply line and a first node; a second impedance connected between the first node and a ground line; and a third impedance connected between a second node and the ground line. The first node is connected to the first input of the second operational amplifier. The second node is connected to the second input of the first operational amplifier.

The device can include: a first impedance connected between a first node and a ground line; and an oscillator, connected to the frequency detector circuit and the first node. The digital-to-analog converter circuit can have 7 bits, the register block can have 7 bits, and the frequency value circuit can have 8 bits. A first impedance can be between a supply line and the digital-to-analog converter circuit. The register block can include 8 registers, and the VCOM voltage output can provide up to 8 different VCOM voltage levels. The frequency detector circuit, frequency value circuit, oscillator, digital-to-analog converter circuit, and register block can reside or be formed on a single integrated circuit.

In an implementation, a method includes: detecting a frequency on a vertical frequency signal line; obtaining a digital frequency value based on the detected frequency; based on the digital frequency value, selecting a value in a register block; connecting the selected value from the register block to a digital-to-analog converter circuit; connecting an output of the digital-to-analog converter circuit to a first operational amplifier; connecting an output of the first operational amplifier to a transistor; connecting the transistor to a second operational amplifier; and generating an output from the second operational amplifier, where the output is a voltage level output based on the detected frequency.

In various implementation, the digital-to-analog converter circuit is a 7-bit digital-to-analog converter circuit. The register block has 8 registers. The transistor is a MOS transistor. The method can include: connecting a first impedance between an first supply voltage and an input of the second operational amplifier circuit; and connecting a second impedance between the input of the second operational amplifier circuit and a second supply voltage. Values of the first and second impedances can be different.

The detecting a frequency on a vertical frequency signal line can be performed by a frequency detector circuit. The method includes: providing an integrated circuit including the frequency detector circuit, register block, and digital-to-analog converter circuit; and providing an oscillator circuit generating a pulse signal that is connected to the frequency detector circuit. The oscillator circuit can be formed or reside on the integrated circuit.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
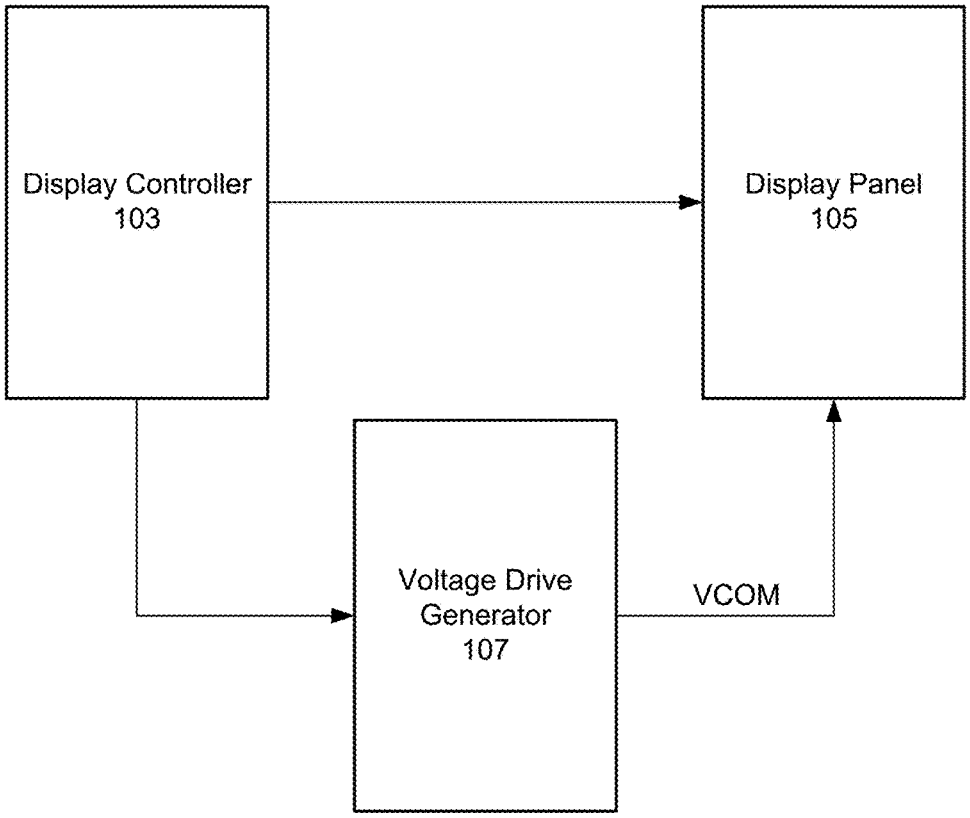
FIG. 1 shows a block diagram of a display system.

FIG. 1 shows a block diagram of a display system. This display system can be incorporated in computer monitors, televisions, instrument panels, aircraft cockpit displays, signage, laptop computers, video players, music players (e.g., Apple's iPod product family), gaming devices, cameras, clocks, watches, calculators, telephones, smartphones (e.g., Apple's iPhone product family, Google's Nexus product family, Samsung's Galaxy product family), tablets (e.g., Apple's iPad product family, Google's Nexus product family, or Samsung's Galaxy product family), and many other devices.

The display system includes a display controller 103 that drives a display panel 105 and a voltage drive generator 107, which also drives the display panel. The voltage drive generator can generate a reference voltage for the display panel.

Figure 2:
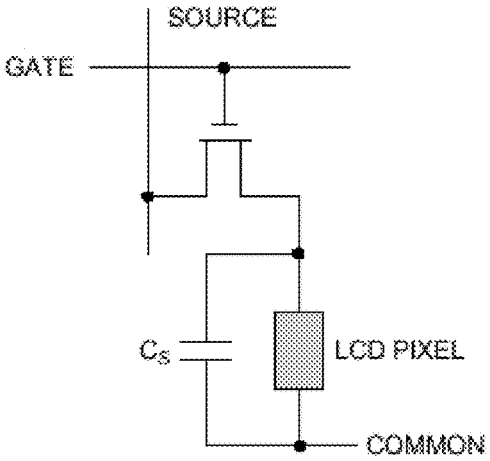
FIG. 2 shows a circuit diagram for a single LCD pixel.

The display system can be an LCD display system, such as for an active matrix thin-film transistor (TFT) display. FIG. 2 shows a circuit diagram for a single LCD pixel. Numerous pixels are arranged in an array to form a display panel. In an implementation, the voltage drive generator generates the VCOM reference voltage for pixels of the display panel.

Some common resolutions for panels includes 7680 by 4320 (e.g., 8K), 4096 by 2304 (e.g., 4K), 3840 by 2160 (e.g., 4K UHD), 2800 by 1800, 2560 by 1200, 2560 by 1400, 1600 by 1200, 1920 by 1080 (e.g., HD 1080), 1280 by 720 (e.g., 720p), 1136 by 640 (e.g., iPhone 5), 1280 by 768, 960 by 640 (e.g., iPhone 4S), 1024 by 768, 800 by 600, 800 by 480, 640 by 480, 480 by 320, and many more.

The TFT LCD is panel includes glass, a TFT array substrate, liquid crystal, a polarizer, color filters, and other components to implement a TFT LCD. The drive electronics of a TFT activate the TFT array substrate, resulting in an induced electromagnetic field that affects the liquid crystal. The liquid crystal is twisted in response to the induced electromagnetic field, allowing light to shine through the liquid crystal and the glass sandwich. The light intensity of the transmitted light is modulated by the color filters to output the desired color.

In other implementations, the display panel can be of another LCD technology, such as a passive-matrix LCD, super-twisted nematic (STN), double-layer STN (DSTN), or color-STN (CSTN). Or the display panel can use organic light emitted diode (OLED). Aspects of the invention can be applied to various display panel technologies.

A VCOM circuit outputs a VCOM reference voltage, which is typically used with or in an LCD screen. LCD screens have an array of pixels constantly lit by a backlight. The constancy of the light removes the type of flicker usually associated with cathode ray tube (CRT) screens (phosphors pulsing with each refresh cycle). Instead, an LCD pixel has upper and lower plates with grooves cut perpendicular to each other as in. These grooves align the liquid crystals to form channels for the backlight to pass through to the front of the panel. The amount of light emitted depends upon the orientation of the liquid crystals and is proportional to the applied voltage.

Referring to FIG. 2, the gate voltage acts as a switch signal and is commonly amplified to become −5 volts to 20 volts. The video source, typically ranging from 0 volts and 10 volts, provides the intensity information that appears across the pixel. The bottom of the pixel is commonly connected to the backplane of the panel. The voltage at this node is VCOM (the VCOM reference voltage).

While this set-up is functional, it reduces panel lifetime. Assuming the VCOM voltage is at ground, the voltage across the pixel varies from 0 volts to 10 volts. Assuming an average of 5 volts, there is substantial DC voltage across each pixel. This DC voltage causes charge storage, or memory. In the long term, it is a form of aging, degrading the pixels by electroplating ion impurities onto one of the electrodes of the pixel. This contributes to image retention, commonly known as a sticking image.

The construction of the LCD panel is generally symmetrical and either a positive or a negative voltage can be used to align the crystals. A technique is to adjust the common voltage (VCOM) to a midpoint of the video signal (e.g., 10/2, which is 5 volts) or other desired voltage level (e.g., 2/3, 3/4, or other percentage of the maximum signal voltage). Now the video signal swings above and below the common voltage (VCOM), creating a net zero effect on the pixel. This net zero effect on the liquid crystal eliminates the aging and image retention issues. A tradeoff for this technique is resolution, since the video signal travels 5 volts to full brightness instead of the entire 10-volt range.

The VCOM voltage should be set very precisely (e.g., around midpoint or ½ of the AVDD power rail, ⅔ of signal voltage, or other value) to avoid flicker. To illustrate why a panel will flicker, let's assume that due to manufacturing of the panel the VCOM is 5.5 volts. If the video signal swings between 0 volts and 10 volts, the full-scale voltage will be different on each field. On one field, the full-scale voltage will be 4.5 volts and on the other, the full-scale voltage will be 5.5 volts. This difference in full-scale voltage translates to a difference in intensity, experienced as flicker.

Due to the variations in construction of each panel, the optimal VCOM voltage can differ from panel to panel or across a single panel. It is important to be able to set the VCOM precisely and also be able to change it as needed to work optimally with a particular panel.

In the specific implementation shown, the display controller and voltage drive generator are circuits residing on separate integrated circuits or different semiconductor substrates. But in other implementation, some or all components of the voltage drive generator can be incorporated into the drive controller integrated circuit (or alternatively, integrated within the display panel).

Previously, displays and their display driver circuits had a fixed refresh rate such as 60 Hertz. Newer displays and their display driver circuits can support variable refresh rates. In such a monitor, the refresh rate can be changed, for example, from about 10 Hertz to about 144 Hertz. Some examples of variable refresh rate technology include G-Sync from Nvidia and FreeSync from AMD, which is also know as Adaptive Sync from VESA. These technologies allow varying of the refresh rate of the graphic processor in order to provide improved visual quality and lower power consumption.

An improved VCOM generator circuit is needed to address variable refresh rate technology. U.S. patent applications 62/242,230, filed Oct. 15, 2015, 62/343,707, filed May 31, 2016, and Ser. No. 15/294,295, filed Oct. 14, 2016, are incorporated by reference.

The display controller or graphic processor (GPU) generates a vertical frequency (fV) using a value set by user or customer manually. The display panel uses the vertical frequency received from the controller. For typical controllers, the amount the vertical frequency ranges can be adjusted is not wide, typically from about 50 Hertz to about 85 Hertz.

However, variable refresh rate technologies, such as G-Sync from nVidia, FreeSync from AMD, and Adaptive Sync from VESA, support a wider range of vertical frequency, from about 10 Hertz to about 144 Hertz, and vertical frequencies are varied during display panel is on operation.

Figure 3:
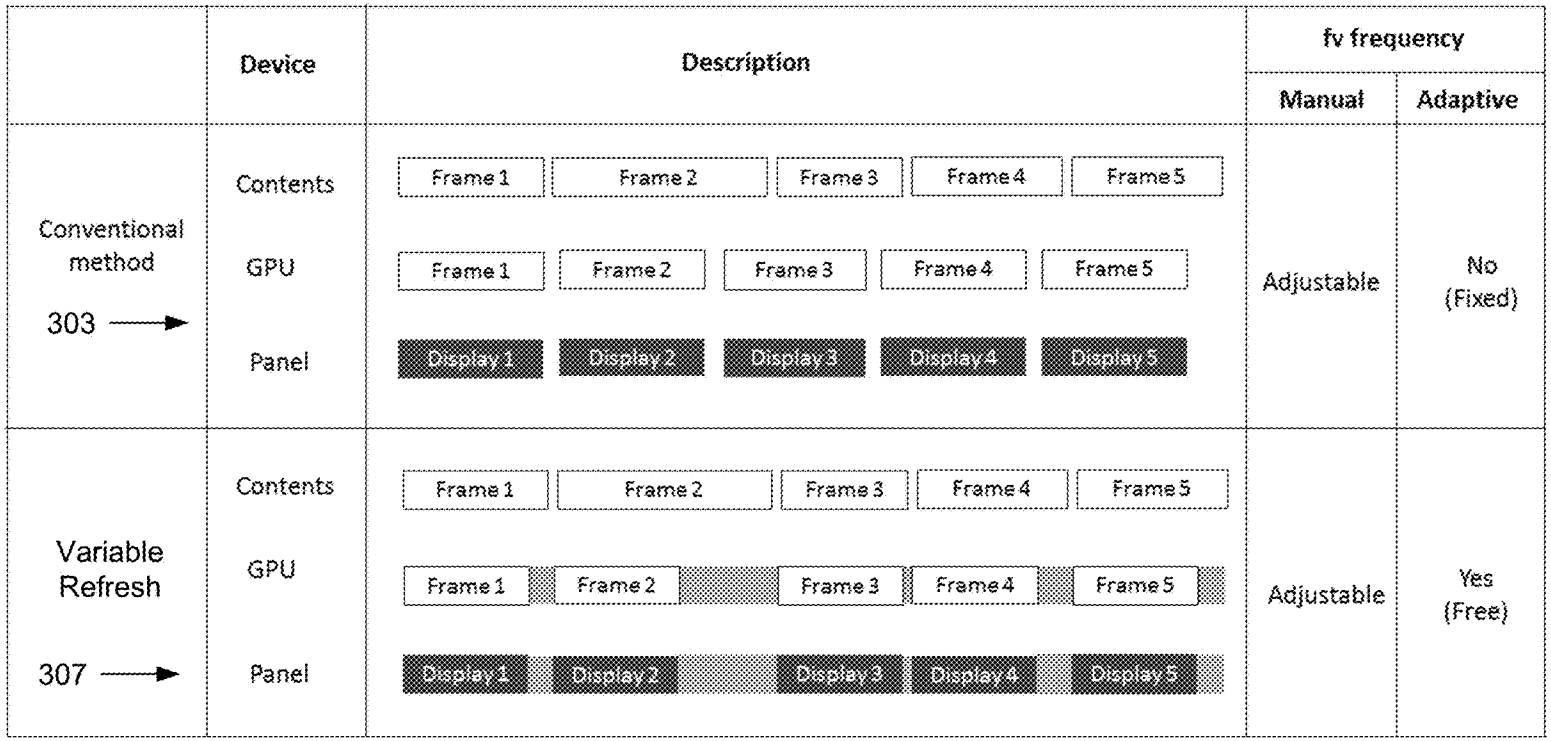
FIG. 3 shows a table of the operation comparing conventional vertical frequency operation and variable refresh rate operation.

FIG. 3 shows a table of the operation comparing conventional vertical frequency operation in row 303 and variable refresh rate operation in row 307. Referring to row 303, in conventional vertical frequency operation, the vertical frequency can be set manually, and does not change or adapt during operation of the display. In other words, after a vertical frequency is selected, that vertical frequency will be used with the display and the vertical frequency will not vary.

Referring to row 307, for variable refresh rate operation, the vertical frequency can be set manually, and can change and adapt during operation of the display. In other words, a vertical frequency can be selected, but during operation with a display, other vertical frequencies can be used, and the vertical frequency can change during operation.

Figure 4:
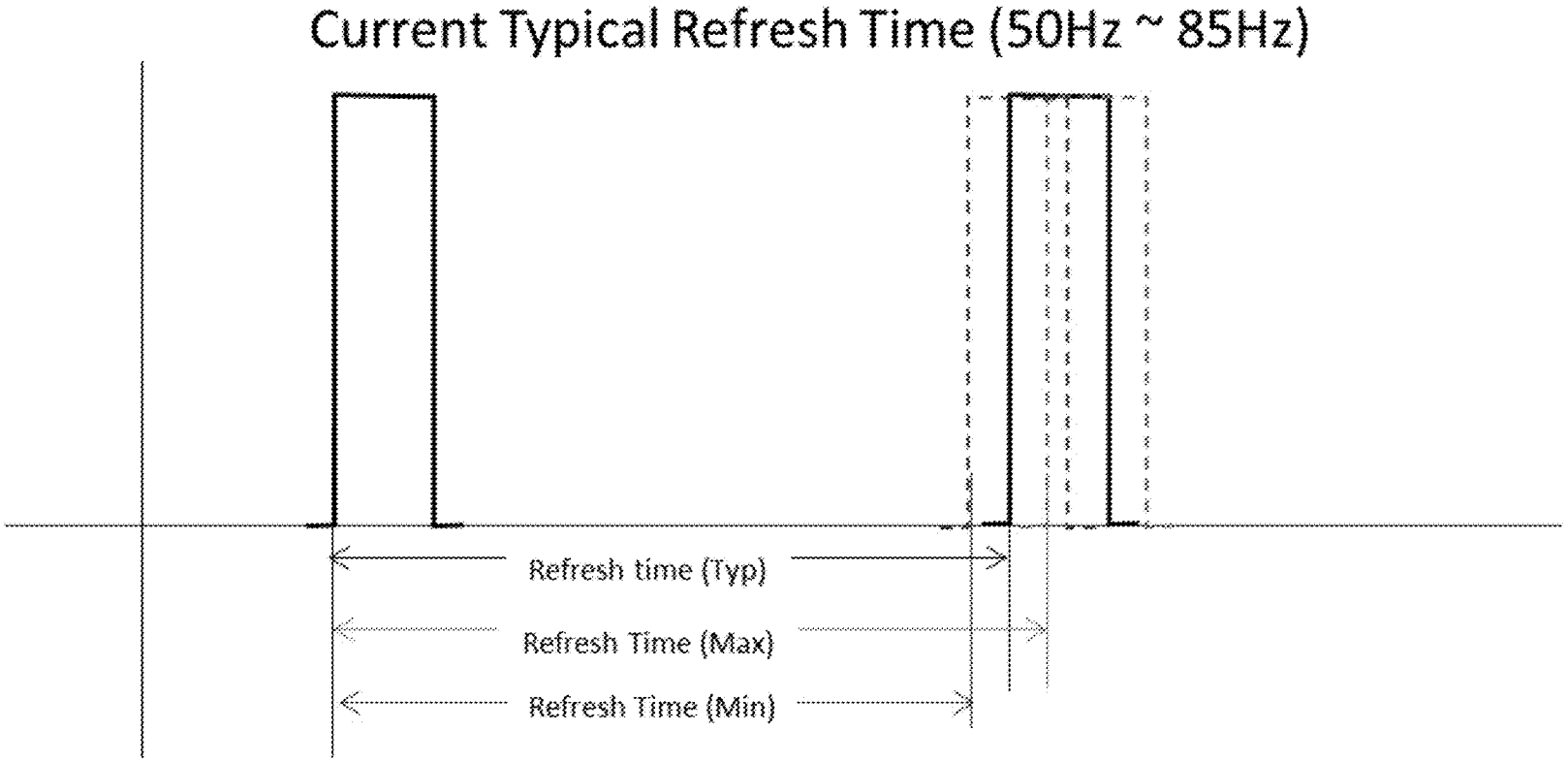
FIG. 4 shows a timing diagram for a typical refresh time of about 50 Hertz to about 85 Hertz.

FIG. 4 shows a timing diagram for a typical refresh time of about 50 Hertz to about 85 Hertz. In case of conventional method, it would be acceptable to manage flicker level with one fixed Vcom level because that ranges of vertical frequencies generated by GPU is not so wide to cause a flickering problem. Typically it is sufficient to adjust and fix the Vcom level for the panel at the factory before the panel is shipped. There would not be a big difference between average voltage level between odd and even when having one fixed Vcom level that can be adjusted.

Figure 5:
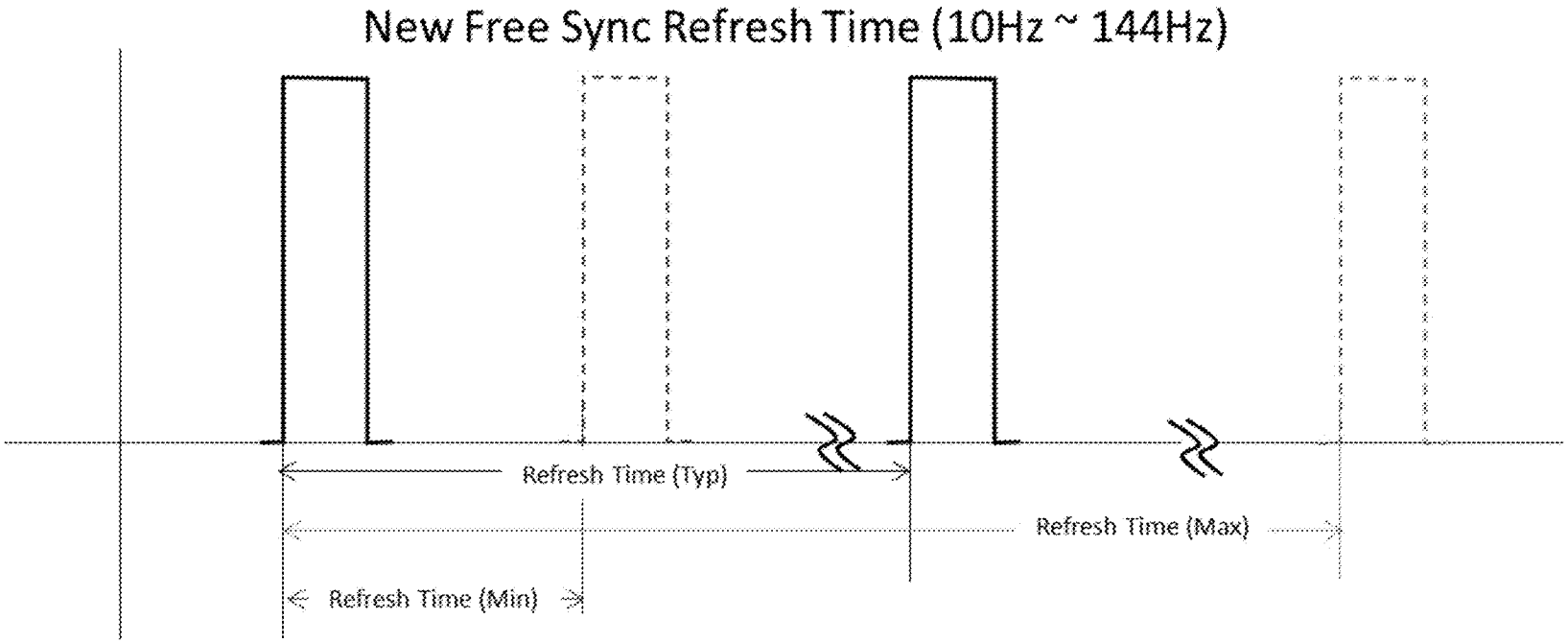
FIG. 5 shows a timing diagram for a variable refresh rate operation, with a wide refresh time from about 10 Hertz to about 144 Hertz.

FIG. 5 shows a timing diagram for a variable refresh rate operation, with a wide refresh time from about 10 Hertz to about 144 Hertz. The timing range for refresh is significantly greater than the conventional range, shown in FIG. 4.

Consequently, in case of variable refresh (e.g., FreeSync), it is difficult to optimize flicker level with one fixed Vcom level because that variable range of vertical frequency is much wider than conventional method. The variation in discharging time will be so great that flicker may result when using a fixed Vcom level.

Figure 6B:
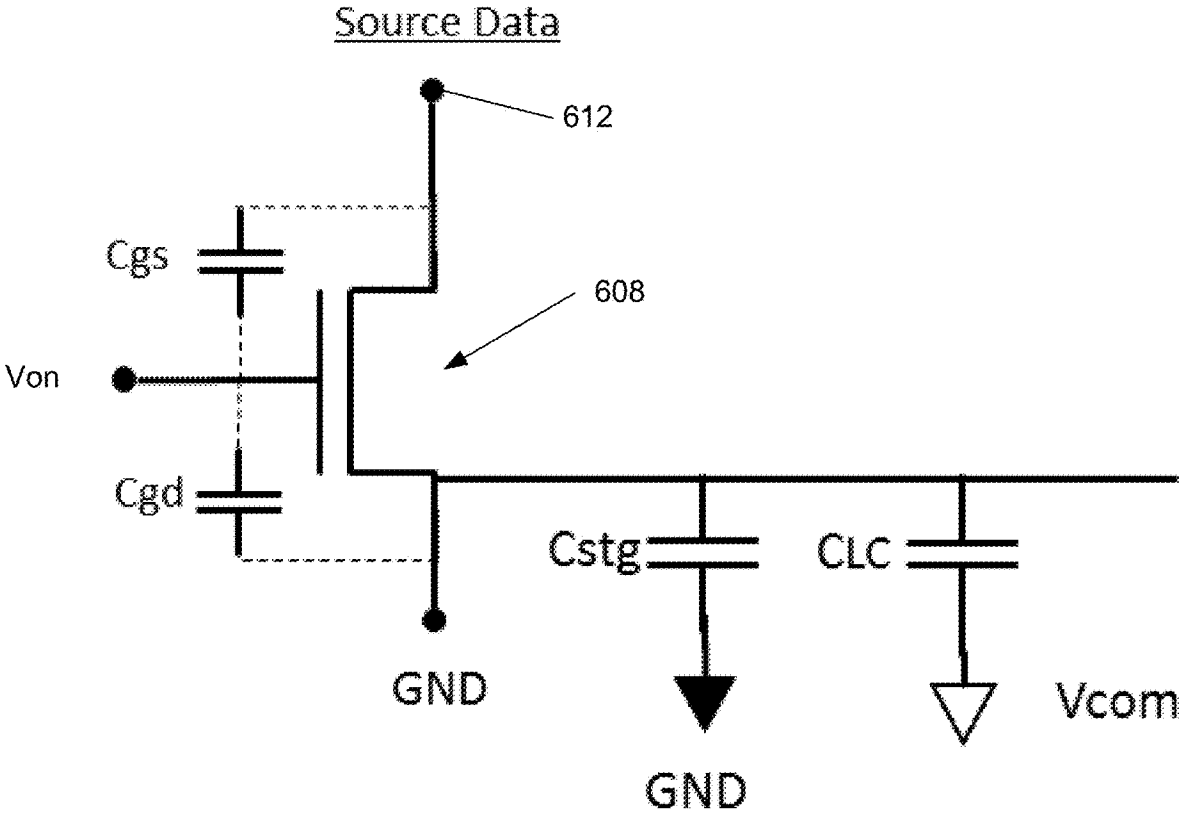
FIG. 6B shows an LCD pixel circuit including capacitances.
Figure 6A:
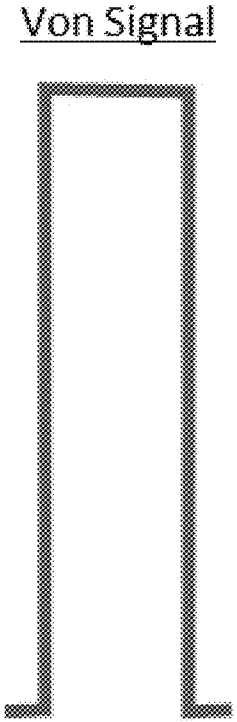
FIG. 6A shows a Von signal waveform.

FIG. 6A shows a Von signal waveform. FIG. 6B shows an LCD pixel circuit including capacitances. The Von voltage is a gate voltage for a transistor 608. A voltage of source data 612 is charges a capacitor Cstg through transistor 608 when Von signal is active on a gate of the transistor.

A liquid crystal element is voltage controlled device. So residual voltage in an electrode affects liquid crystal performance. A phase of source data voltage for a liquid crystal element in a panel should be inverted periodically in order to prevent trapping of ions in isolated layers because trapped ions operate like a residual voltage.

The circuit has not only Cstg and CLC capacitors or capacitances, but also Cgs and Cgd parasitic capacitances. These parasitic capacitances can cause asymmetric voltages between an even period and odd period operation.

Voltage (even) from source data 612 charges Cstg while Von is active. The charge stored by Cstg may drop a little when Von goes inactive. Further, the charge stored by Cstg slowly discharges toward to ground (not Vcom) until Von goes active again. Voltage (odd) from source data charges Cstg again. The charge stored by Cstg voltage may drop a little when Von goes inactive. Further, the charge stored by Cstg slowly discharges toward to ground until Von goes active again.

A voltage phase of the liquid crystal is decided based on Vcom (not ground). The charged voltage at Cstg is based on GND and operation of the liquid crystal is based on Vcom so applied voltage shape (area) at the liquid crystal between odd and even are different.

Figure 7:
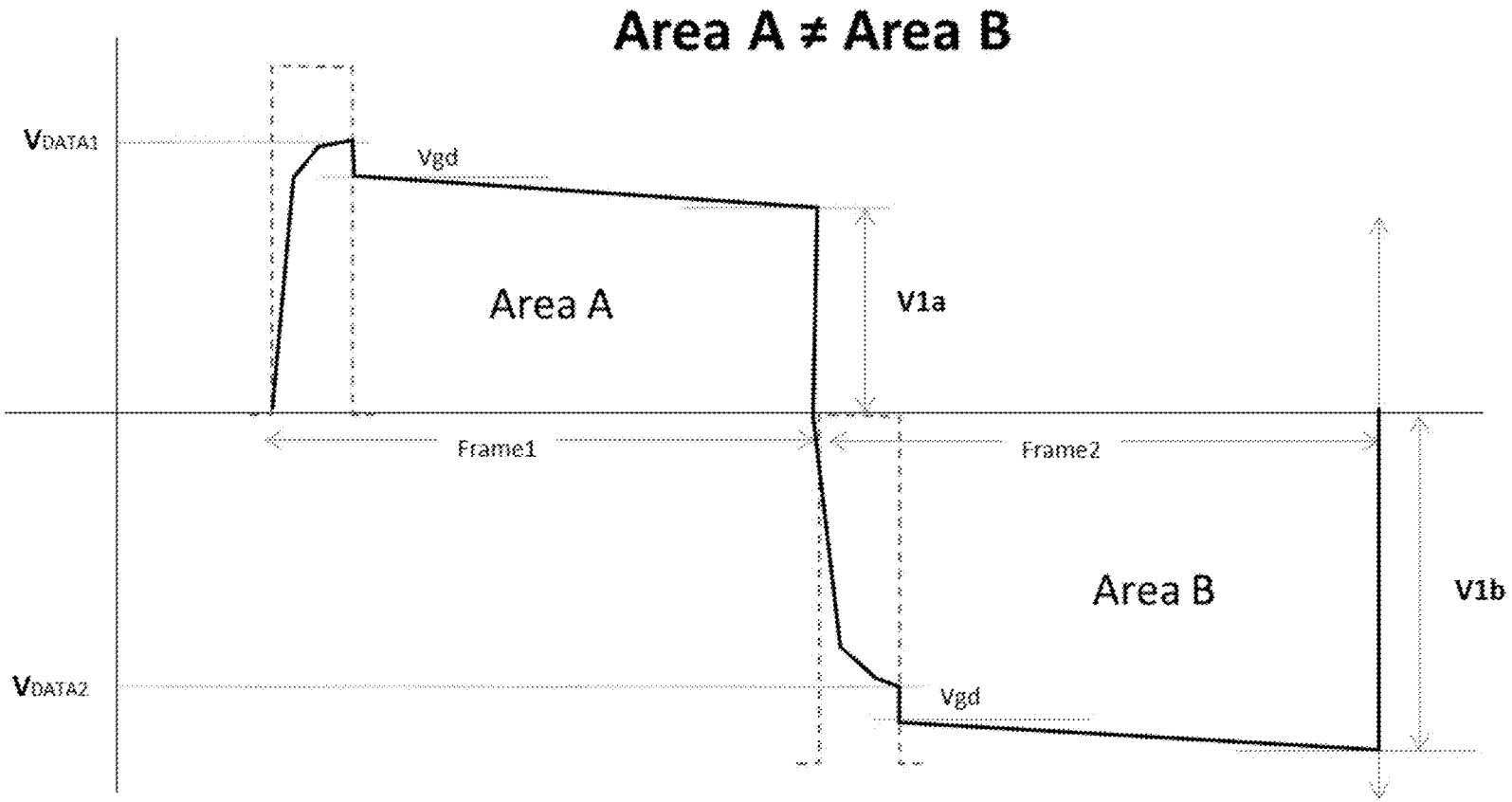
FIG. 7 shows a graph of voltage and discharge time for a single, fixed Vcom level.

FIG. 7 shows a graph of voltage and discharge time for a single, fixed Vcom level. In this example, ratio of area A' and area B': will be larger with fixed Vcom level because discharging time is longer. This means a gap of area A' and area B' will be larger and will make a larger flicker level. It is difficult to avoid flicker when using a fixed Vcom level.

Figure 8:
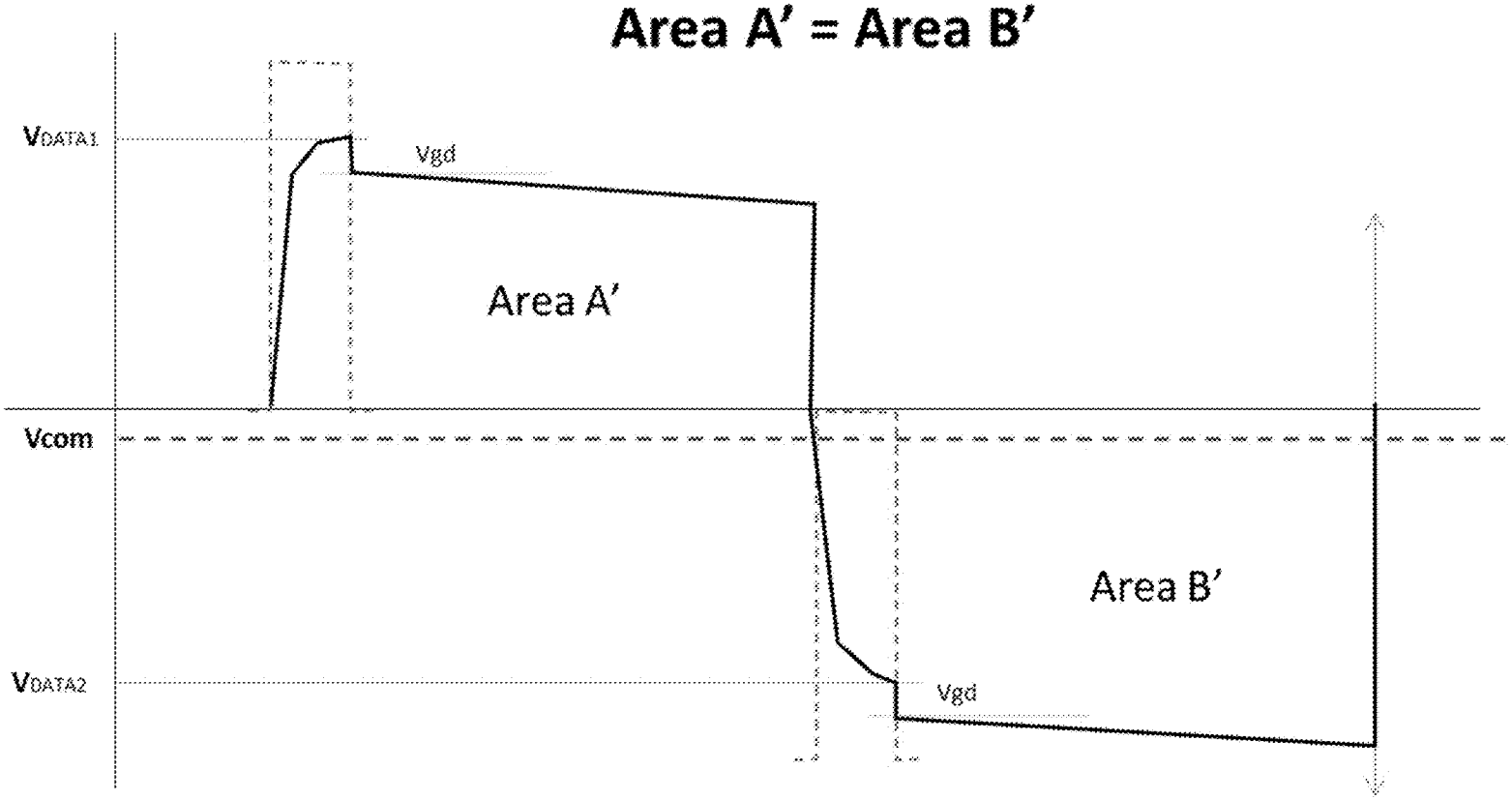
FIG. 8 shows a graph of voltage and discharge time for a variable Vcom level.

FIG. 8 shows a graph of voltage and discharge time for a variable Vcom level. To prevent or reduce flicker, a variable Vcom level can be used. A gap of area A and area B is compensated for by using a variable Vcom level.

Therefore, by tuning the Vcom voltage level, this will allow applying of symmetric average voltage to the LCD. Normally a level of Vcom is adjusted and fixed to minimize flicker level while at the factory and before panel is shipped out. Once set at the factory, the Vcom level is not changed again.

An adaptive Vcom level generator circuit (AVLG) supports (i) variable Vcom levels that are adaptively changed based on different vertical frequencies or (ii) variable Vcom levels that are changed based on external control signals. The circuit to generate variable Vcom levels may also be referred to as a variable Vcom level generator (VVLG).

Figure 9:
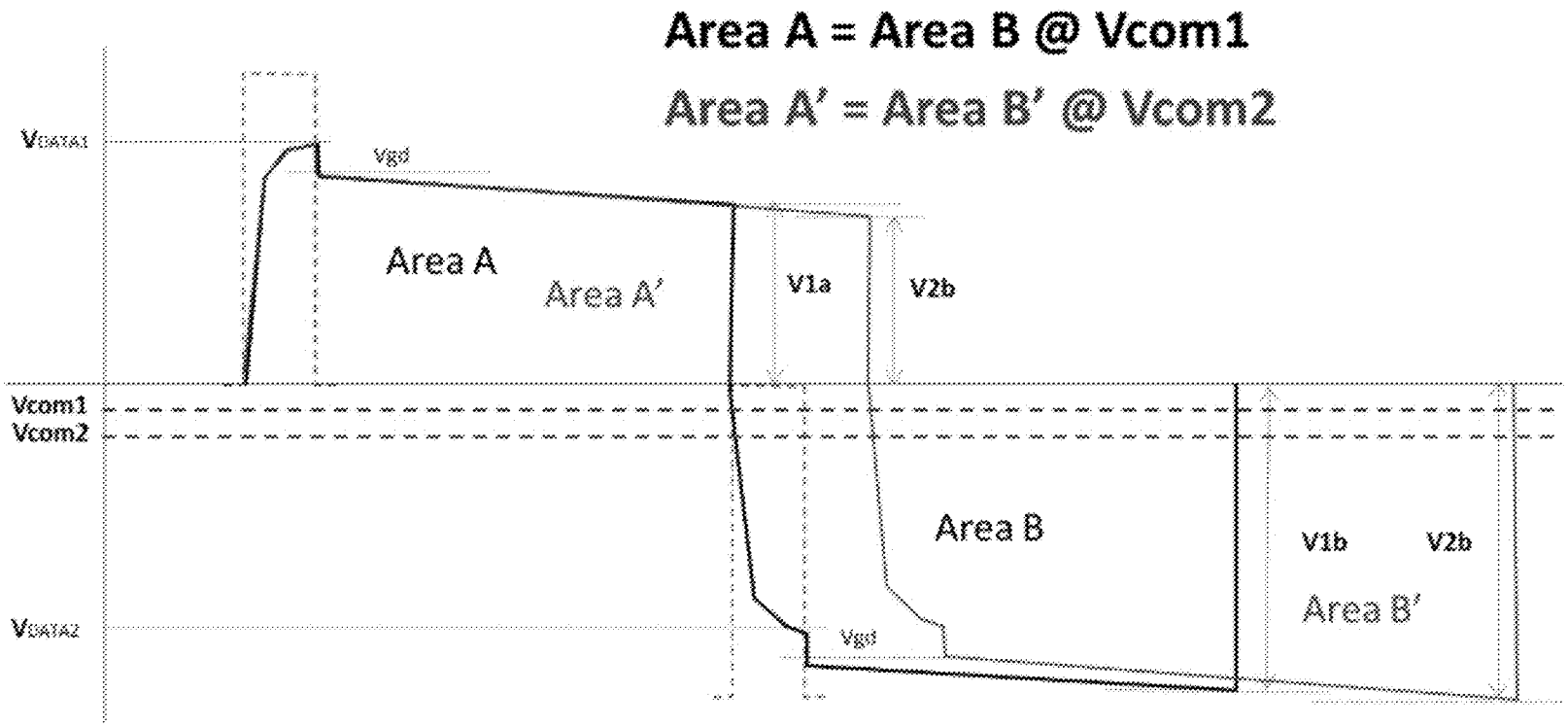
FIG. 9 shows a graph of voltage and discharge time for a variable Vcom at a Vcom1 level and Vcom2 level.

FIG. 9 shows a graph of voltage and discharge time for a variable Vcom at a Vcom1 level and Vcom2 level. When the display controller or GPU can generate different vertical frequencies, with the adaptive Vcom level generator circuit, the Vcom level can also be changed to make a more balanced area (e.g., area A=area B). As shown, an area A is equal to area B at a Vcom1 level. An area A' is equal to area B' at a Vcom2 level. Thus, using a variable Vcom level, flicker will be minimized by minimizing a gap or difference between of area A and area B.

Figure 10:
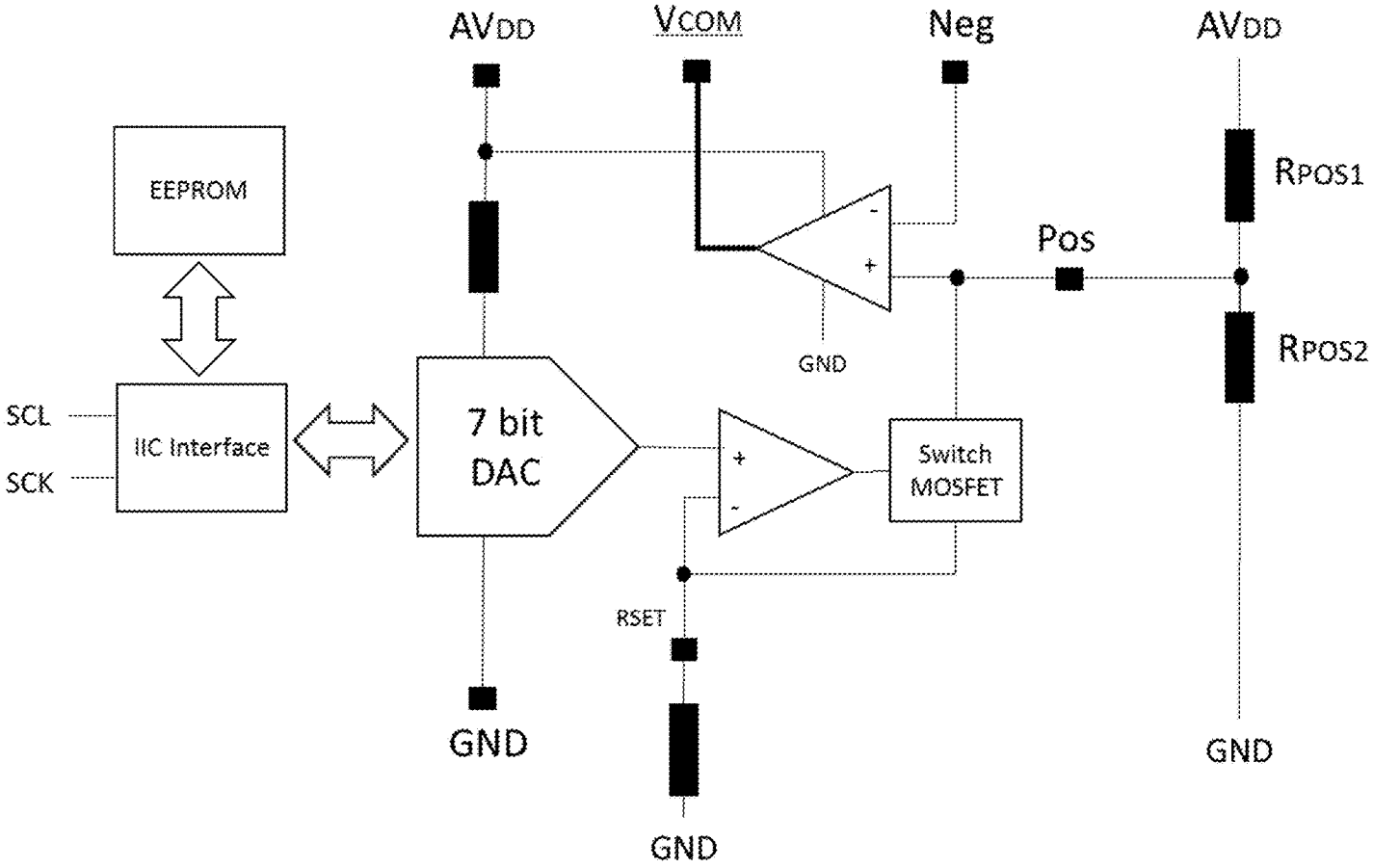
FIG. 10 shows a block diagram of a Vcom generator circuit.

FIG. 10 shows a block diagram of a Vcom generator circuit. This circuit includes a DVR (digitally variable resistor) block, I2C interface block, EEPROM or Flash storage, and power amplifier. A Vcom level is set through an I2C interface and is stored in the EEPROM. The Vcom level is not changed until a user writes a value of the Vcom level through I2C interface again.

It is not practical to write Vcom values while using this circuit with an LCD monitor. The typical user does not have access to specialized tools (e.g., hardware or software, or both). Also, it takes some time to write through I2C interface. It is impractical to change Vcom levels quickly in a Vcom generator of this configuration to avoid flicker because for variable refresh rate technology, the vertical frequency can be changed quickly (e.g., frequently and without advance notice) and the amount of rate change can be in a relatively wide rage.

The I2C bus interface (or Inter-Integrated Circuit) is a multiple master serial single-ended computer bus developed by Philips that is used to attach low-speed peripherals to a motherboard, embedded system, cellphone, or other electronic device. The I2C specification can be found at the NXP Semiconductor Web site and documented in Philips Semiconductors, "The I2C-Bus Specification, Version 2.1," January 2000 (document order no. 9398 383 40011). Documents on the I2C interface are incorporated by reference. The I2C bus interface is sometimes referred to as the IIC bus interface.

Figure 11:
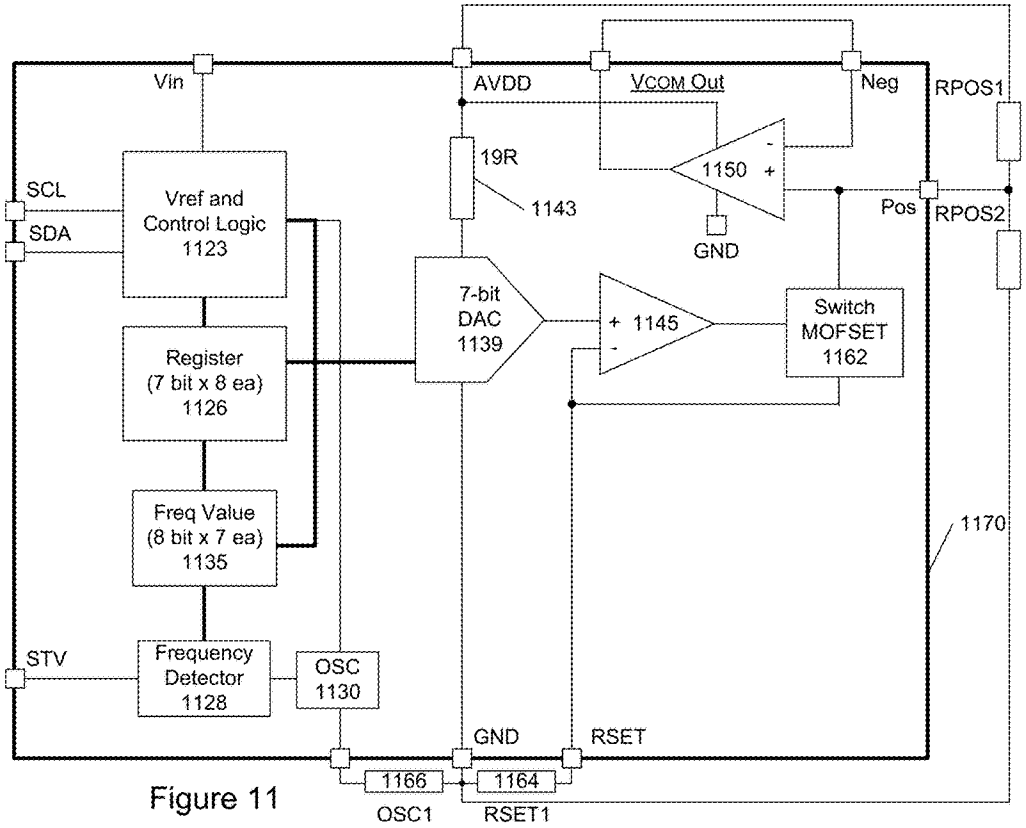
FIG. 11 shows a block diagram of an adaptive or variable Vcom level generator circuit.

FIG. 11 shows a block diagram of an adaptive or variable Vcom level generator circuit. This circuit includes a DVR block, driver amp, digital interface 1123, additional registers 1126, frequency detector 1128, oscillator 1130, and frequency values (or ranges) circuit 1135. Compared to the FIG. 10 circuit, the adaptive Vcom level generator additionally includes registers 1126, frequency detector 1128, oscillator 1130, and frequency values circuit 1135 (which stores frequency values or ranges). Registers 1126 can be implemented using memory, static or dynamic memory (SRAM or DRAM), EEPROM, Flash, PLA, PLD, FPGA, latches, flip flops, register file, or other volatile or nonvolatile storage and related circuits.

In order to generate the adaptive Vcom level, a frequency of STV (vertical frequency) of video data is detected. Then a specific frequency value (or range) for defining a specific Vcom level at specific frequency value (or range) is set.

The STV video signal or the vertical frequency sync signal is a timing signal with pulses to indicate the start of a new field of a view. To display video (e.g., television signals), the fields of the video are at a particular vertical frequency. For interlaced video, two fields make up one frame. For progressive video, there is one field per frame. The STV signal has a series pulse that indicates the start of a new field. The time between pulses gives a period of the vertical frequency. And the inverse of the period is the vertical frequency. The vertical frequency is also known as the refresh rate or scanning rate. Using the STV signal, one can determine the vertical frequency.

A function of frequency detection is to detect a frequency of vertical (or STV). A function of a frequency range register is to store specific frequency ranges that are written by user through a digital interface. A specific frequency range is selected by a value of a frequency that is detected by the frequency detection block. The selected specific frequency range represents an address of additional registers that have values of Vcom levels.

Register 1126 is connected a digital-to-analog converter (DAC) 1139. Although a register is described, any other technique used to store binary values in a chip may be used including memory, static memory or SRAM, EEPROM, Flash, PLA, PLD, FPGA, flip flops, registers, and others, and combinations of these. In a specific implementation, the DAC is 7 bits. However, in other implementations can use a DAC have less than 7 bits (e.g., 1, 2, 3, 4, 5, or 6 bits) or more than 7 bits (e.g., 8, 10, 12, 14, 16, 18, 20, 24, 32, or other number of bits). AVDD connects through an impedance 1143 (e.g., resistor or resistance) to provide power the DAC. The DAC is connected to a first operational amplifier or op amp 1145.

For a 7-bit or n-bit DAC, and the register (e.g., register file or memory) will have a similar number of bits—7 or n bits. There can be eight registers in the register file (or eight memory locations) to allow storing of up to eight different values. This will allow up to eight different VCOM levels. The amount of memory of number of registers can vary depending on the number of VCOM levels desired.

AVDD (e.g., analog VDD supply) supplies power to the first op amp (not shown) and to a second operational amplifier 1150. VCOM is connected to an output of the second op amp. A negative (−) input of the second op amp is connected to a NEG node, which is connected a pin or pad. A positive (+) input of the second op amp is connected to a bias voltage generated by a divider of resistors or resistances RPOS1 and RPOS2. In a specific implementation, the NEG node is connected to the VCOM output node. The connection between NEG and VCOM nodes may be made by external connection, which is external to an integrated circuit having these nodes as external pads.

In an implementation, the second op amp can be a unity gain buffer or a voltage follower, where the output voltage follows or tracks the input voltage provided at the positive and negative inputs. The negative input to the second op amp is the NEG node.

This bias voltage may also be referred to as a DVR output (POS). RPOS2 is also connected to ground. The POS node is connected to a pin or pad. The POS node is connected between RPOS1 and RPOS2 is connected to a first node or electrode (e.g., drain node) of a transistor 1162 (e.g., a switch MOSFET). A second node (e.g., source node) of the transistor is connected to a negative (−) input of the first op amp and to a RSET node. The POS node is connected to a pin or pad. The RSET node is connected to a resistor or resistance RSET1 1164. RSET1 is also connected to ground.

In an implementation, the transistor is an n-channel or NMOS transistor, but in other implementation, the transistor can be a p-channel or PMOS transistor. In still further implementations, the transistor can be a bipolar (or BJT) or JFET transistor. An output of the first op amp is connected to a third node (e.g., gate node) of the transistor.

In an implementation, the components within box 1170 reside on a single integrated circuit or chip. These components include interface 1123, register 1126, DAC 1139, impedance 1143, op amp 1145, op amp 1150, and transistor 1162. The components RSET1 1164, OSC1 1166, RPOS1, and RPOS2, which are impedances (e.g., resistors or resistances), are external to this integrated circuit. Externals pads of integrated circuit include Vin, AVDD, VCOM Out, NEG, POS, RSET, and GND. In an implementation, one or more of the resistors RPOS1, RPOS2, RSET1, or OSC1 in any combination, are part of the single integrated circuit. The impedances or resistances described in the application can have different values, or two or more may have the same value, in any combination.

In another implementation, components within box 1170 can reside on multiple integrated circuits or chips. For example, op amp 1145 and op amp 1150 can be on separate integrated circuits. In a further example, interface 1123 and register 1126 are on a separate integrated circuit from the DAC and op amps.

Oscillator 1130 can be implemented using a ring oscillator circuit, such as an inverter chain with an odd number of inverters (e.g., 1, 3, 5, 7, 9, 11, 12, or other). There can be resistance-capacitance-inductance (RCL) loads resistance-capacitance loads between one or more stages or each and every stage. The output of the ring oscillator is a pulse train, square wave signal, or other clock-type signal. A desired oscillator frequency can be obtained by adjusting the number of stages and loads. External resistor OSC1 1166 can also be provided to adjust or vary the oscillation frequency by the user. In other implementations, the oscillator can be an external circuit, not residing on the same integrated circuit as the other components (such as frequency detector 1128). For example, a quartz crystal oscillator or clock generator integrated circuit can be used as external oscillator, which would have a clock output that would connect to the frequency detector 1128 through an external pad.

Compared to the Vcom circuit in FIG. 10, the variable Vcom circuit includes the digital interface and register. By way of the register control signals, a control circuit can select a particular voltage level for the Vcom voltage.

There can be any number of voltage levels, two or more (e.g., 2, 3, 4, 5, 6, 7, 8, 9, 16, 24, and more). The number of voltage levels (n+1) is related to the number of control lines by 2^n (which is 2 to the nth power), where n is an integer, 0 or greater. For example, for 8 voltage levels, these can be selected via three register control lines. For 16 voltage levels, these can be selected via four register control lines.

Using the digital interface control signals (e.g., IIC, MIPI, or SPI) such as SCL and SDA, the circuitry allows a user to specify preset or selected values Vcom levels to be associated with a specific register. For example, the Vcom circuit may have eight register locations, selectable via three S control bits. Via digital interface 1123 (e.g., IIC, MIPI, or SPI signals), a user can assign a Vcom1 level to register location 011 (decimal 3) and a Vcom level 4 to register location 100 (decimal 5). Then, when the control circuit sends 011 to the S controls bits, the digital analog converter (DAC) converts, and the Vcom level will be set to Vcom1.

In an implementation, the VCOM output levels are a function of a VCOM register value (which is the value output from register 1126 to the DAC), RPOS1 resistance value, RPOS2resistance value, RSET resistance value, and the DAC reference voltage or AVDD.

Figure 12:
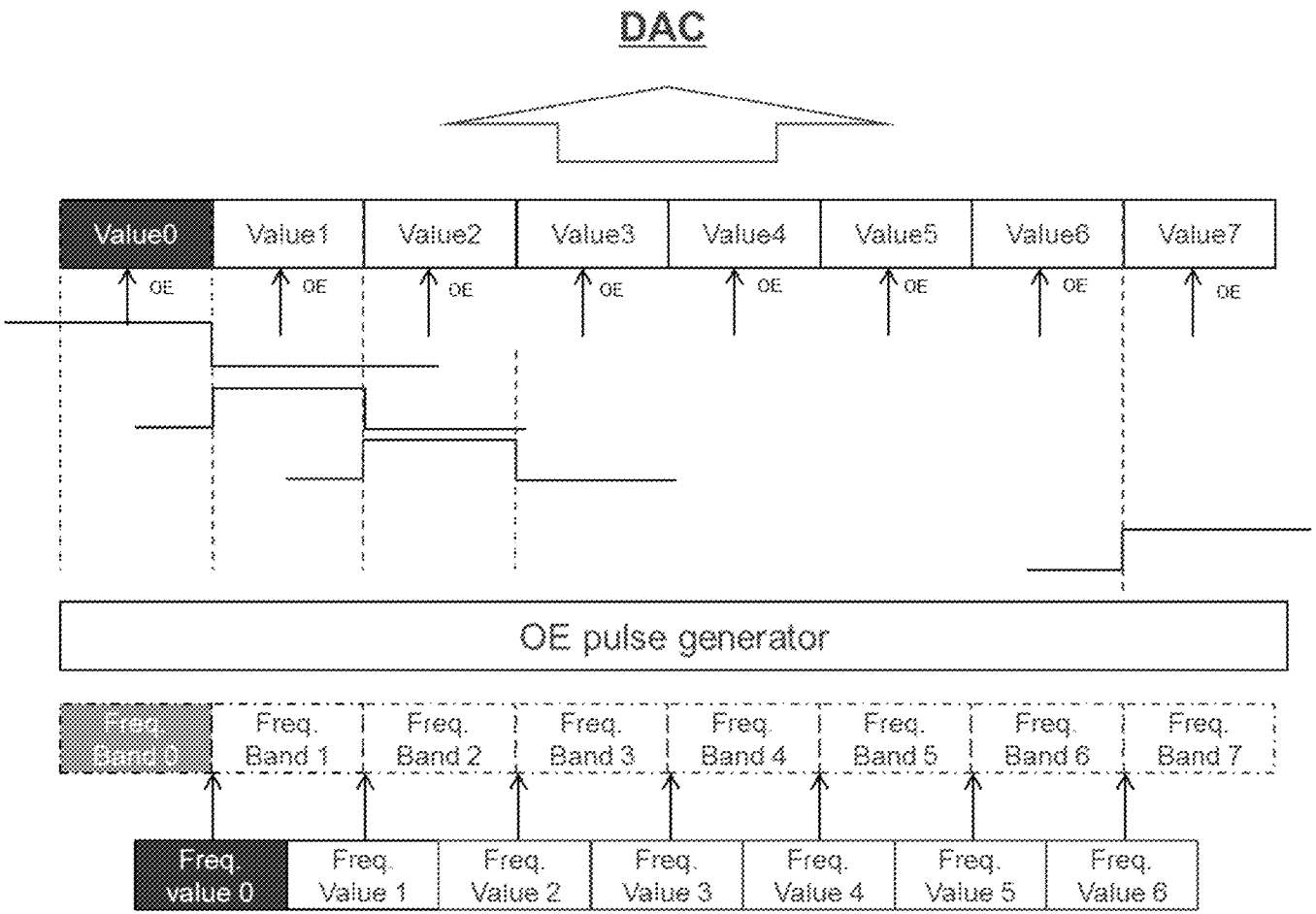
FIG. 12 shows a chart of different frequency values, corresponding frequency bands, and corresponding values for a digital to analog converter.

FIG. 12 shows a chart of different frequency values, which correspond to a frequency band (e.g., frequency bands 0-7), which enable a value (e.g., values 0-7) that is connected to an digital to analog converter (DAC) by using output enable (OE) circuitry. The output enable circuitry can be used to disable values other than the selected value to connect to the DAC).

Further, the adaptive Vcom level generator can generate a variable Vcom level by itself without support of T-con. It does not require additional support of T-con. So if panel is using an adaptive Vcom level generator, panel will support a low flicker display with conventional T-con even if the display controller sends an adaptive sync video data to the panel.

The T-con circuit typically refers to a circuit or printed circuit board of a display (e.g., LCD panel). The T-con circuit provides control logic signals for driving the display. Sometimes the T-con circuit is referred to as a timing controller circuit, control circuit, controller board, or control board.

For example, for a frequency value 0, this will for display refresh frequencies in a frequency band or range 0. Then via an OE pulse generator, a value0 is selected and enabled, which passes value0 to an input of the DAC. Then based on value0, an appropriate Vcom level output for the refresh frequency is used.

The circuitry uses output enable signals to enable a selected value from the register to input to DAC 1139. One having ordinary skill in the art recognizes there are other circuits and techniques to select one of register values to output to the DAC while not selecting the other registers, and any of these can be used instead.

For example, a multiplexer can be used. All register outputs are input to the multiplexer. The output of the multiplexer is connected to the DAC. The control or selection input of the multiplexer is connected to the frequency value 1135, which selects one of the registers to output to the DAC. Other circuits can be used such as using transmission gates and pass transistors. By changing the value input to the DAC, the Vcom output voltage will be adjusted or change.

Figure 13:
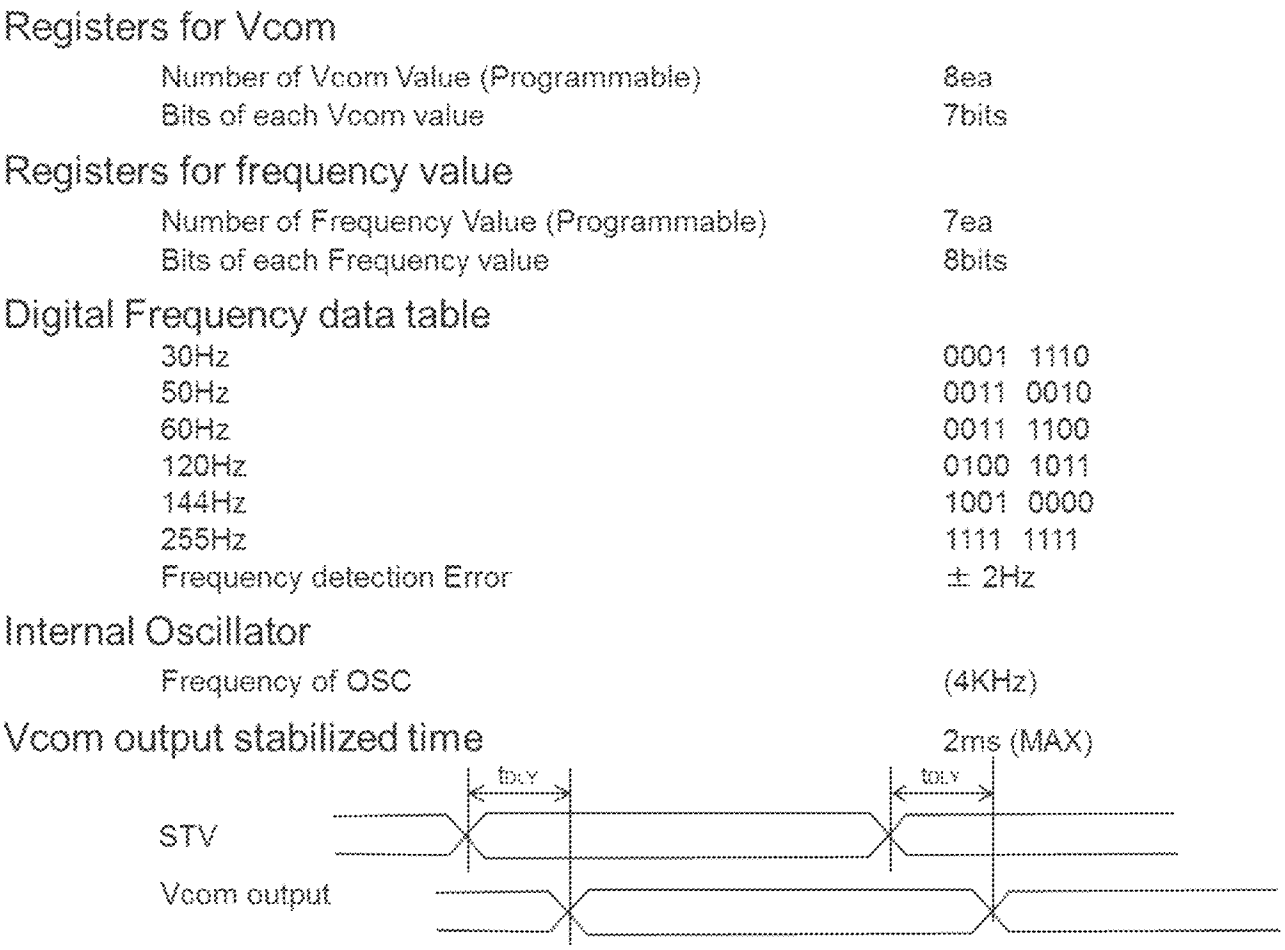
FIG. 13 shows some suggested basic specifications for an adaptive Vcom level generator.

FIG. 13 shows some suggested basic specifications for an adaptive Vcom level generator. In an implementation, for the Vcom, there are 8 programmable registers, each having 7 bits. For the frequency values, there are 7 programmable memories or registers, each having 8 bits. A digital frequency table has values: 30 hertz, 0001 1110 (1E in hexadecimal); 50 hertz, 0011 0010 (32 in hexadecimal); 60 hertz 0011 1100 (3C in hexadecimal); 120 hertz, 0100 1011 (4B in hexadecimal); 144 hertz, 1001 0000 (90 in hexadecimal), and 255 hertz, 1111 1111 (FF in hexadecimal). For example, these values can be stored in frequency value circuit 1135. A frequency detection value is about plus or minus 2 hertz. A frequency of the internal oscillator is about 4 kilohertz. A specification of a Vcom output stabilization time has a maximum time of about 2 milliseconds.

The values programmed into the register and digital frequency table (stored in frequency value circuit 1135) can be by way of digital interface 1123 (e.g., via IIC, MIDI, or SPI protocols). Digital interface 1123 can also controls operation of the oscillator 1130, such as selecting or altering its frequency. The output of the oscillator is input to frequency detector 1138 which uses its pulse signal output (at a particular frequency) to determine a frequency of the STV signal. For example, since the oscillator frequency is known (e.g., 4 kilohertz), the frequency detector can determine a frequency difference between the known frequency and the STV frequency, thus calculating the STV frequency.

As an example of an operation of a circuit implementation, a frequency of 30 hertz is detected by frequency detector 1128 (having input from oscillator 1130) and input to frequency value circuit 1135. Based on the detected frequency (e.g., 30 hertz), the frequency value circuit outputs a binary value 0001 1110 to register 1126. Based on this binary value (e.g., 0001 1110), an appropriate register is output enabled to input to DAC 1129. The Vcom output level is adjusted according to the binary value and detected frequency. As the refresh frequency of the display changes, the frequency detector detects the change, and a different value from the frequency value circuit is output to the register, and a different binary value from the register is input to the DAC. There will be a change in the Vcom output level that will be appropriate the newly detected frequency.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A device comprising:

a frequency detector circuit, coupled to a vertical frequency signal line of a display;

a frequency value circuit, coupled to the frequency detector circuit, wherein the frequency value circuit comprises a digital frequency data table comprising rows and columns, wherein each row comprises a column to store a digital frequency value corresponding to a frequency assigned to that row;

a register block, coupled to receive a digital frequency value from the frequency value circuit;

a digital-to-analog converter circuit, coupled to the register block;

a first operational amplifier, comprising a first input coupled to the digital-to-analog converter circuit;

a transistor coupled to an output and a second input of the first operational amplifier;

a second operational amplifier, comprising a first input coupled to the transistor and an output coupled to a VCOM voltage output;

a first impedance coupled between a supply line and a first node;

a second impedance coupled between the first node and a ground line; and a third impedance coupled between a second node and the ground line, wherein the first node is coupled to the first input of the second operational amplifier, and the second node is coupled to the second input of the first operational amplifier.

2. The device of claim 1 comprising:

an oscillator, coupled to the frequency detector circuit.

3. The device of claim 2 wherein the frequency detector circuit, frequency value circuit, oscillator, digital-to-analog converter circuit, and register block reside on a single integrated circuit.

4. The device of claim 1 comprising:

a digital interface control circuit, coupled to the register block and the frequency value circuit.

5. The device of claim 1 comprising:

an oscillator, coupled to the frequency detector circuit and the third node.

6. The device of claim 1 wherein the digital-to-analog converter circuit comprises 7 bits, the register block comprises 7 bits, and the frequency value circuit comprises 8 bits.

7. The device of claim 1 wherein the register block comprises 8 registers, and the VCOM voltage output can provide up to 8 different VCOM voltage levels.

8. The device of claim 1 wherein the first and second impedances are different.

9. The device of claim 1 wherein the first and third impedances are different.

10. The device of claim 1 wherein the first, second, and third impedances are different.

11. A method comprising:

detecting a frequency on a vertical frequency signal line;

obtaining a digital frequency value based on the detected frequency;

based on the digital frequency value, selecting a value in a register block;

coupling the selected value from the register block to a digital-to-analog converter circuit;

coupling an output of the digital-to-analog converter circuit to a first operational amplifier;

coupling an output of the first operational amplifier to a transistor;

coupling the transistor to a second operational amplifier; and generating an output from the second operational amplifier, wherein the output is a voltage level output based on the detected frequency;

coupling a first impedance between a first supply voltage and an input of the second operational amplifier circuit;

coupling a second impedance between the input of the second operational amplifier circuit and a second supply voltage, wherein the first and second impedances are different; and coupling a third impedance between a second node and the ground line.

12. The method of claim 11 wherein the digital-to-analog converter circuit is a 7-bit digital-to-analog converter circuit.

13. The method of claim 11 wherein the register block comprises 8 registers.

14. The method of claim 11 wherein the transistor is a MOS transistor.

15. The method of claim 11 wherein the detecting a frequency on a vertical frequency signal line is performed by a frequency detector circuit, and the method comprises:

providing an integrated circuit comprising the frequency detector circuit, register block, and digital-to-analog converter circuit; and providing an oscillator circuit generating a pulse signal that is coupled to the frequency detector circuit, wherein the oscillator circuit is formed on the integrated circuit.

16. The method of claim 11 wherein the second node is coupled to an input of the first operational amplifier.

17. The method of claim 11 wherein the second node is coupled to an oscillator circuit.

18. A device comprising:

a frequency detector circuit, coupled to a vertical frequency signal line of a display;

a frequency value circuit, coupled to the frequency detector circuit, wherein the frequency value circuit comprises a digital frequency data table comprising rows and columns, wherein each row comprises a column to store a digital frequency value corresponding to a frequency assigned to that row;

a register block, coupled to receive a digital frequency value from the frequency value circuit;

a digital-to-analog converter circuit, coupled to the register block;

a first operational amplifier, comprising a first input coupled to the digital-to-analog converter circuit;

a transistor coupled to an output and a second input of the first operational amplifier; a second operational amplifier, comprising a first input coupled to the transistor and an output coupled to a VCOM voltage output;

an oscillator, coupled to the frequency detector circuit;

a first impedance coupled between a supply line and a first node;

a second impedance coupled between the first node and a ground line; and a third impedance coupled between a second node and the ground line, wherein the first node is coupled to the first input of the second operational amplifier, and the second node is coupled to the oscillator.

19. The device of claim 18 comprising:

a digital interface control circuit, coupled to the register block and the frequency value circuit.

20. The device of claim 18 wherein the digital-to-analog converter circuit comprises 7 bits, the register block comprises 7 bits, and the frequency value circuit comprises 8 bits.

21. The device of claim 18 wherein the register block comprises 8 registers, and the VCOM voltage output can provide up to 8 different VCOM voltage levels.

22. The device of claim 18 wherein the frequency detector circuit, frequency value circuit, oscillator, digital-to-analog converter circuit, and register block reside on a single integrated circuit.

* * * * *